United States Patent [19]

Harris et al.

[11] Patent Number: 4,858,838

[45] Date of Patent: Aug. 22, 1989

[54] WINDER FLY WASTE MANAGEMENT SYSTEM

[75] Inventors: Paul S. Harris, Chester; Larry E. Stevens, Chesterfield, both of Va.

[73] Assignee: Allied-Signal Inc., Morris Township, Morris County, N.J.

[21] Appl. No.: 175,654

[22] Filed: Mar. 24, 1988

Related U.S. Application Data

[63] Continuation of Ser. No. 924,387, Oct. 29, 1986, abandoned.

[51] Int. Cl.[4] ..... B65H 54/28

[52] U.S. Cl. ..... 242/43 A; 242/35.5 R; 242/43 R

[58] Field of Search ..... 242/43 A, 43 R, 18 R, 242/18 A, 35.5 R, 35.6 R; 57/304, 305

[56] References Cited

U.S. PATENT DOCUMENTS

| | | | |
|---|---|---|---|
| 1,622,607 | 3/1927 | Peterson | 242/35.6 R |
| 1,982,997 | 12/1934 | Linder | 57/304 X |
| 3,650,486 | 3/1972 | Hasegawa et al. | 242/43 A |
| 4,230,285 | 10/1980 | Lenk et al. | 242/43 R |

*Primary Examiner*—Stanley N. Gilreath
*Attorney, Agent, or Firm*—William H. Thrower

[57] ABSTRACT

In yarn traversing apparatus comprising at least two pairs of coaxially disposed rotary blades each mounted on separate coaxially disposed rotatable shafts, the improvement comprising each rotary blade having associated therewith means to provide a smooth contoured outline serving to reduce substantially protrusions and crevices associated with said rotary blades and said rotatable shafts, and means to direct air across said blades, in an amount sufficient to remove fly waste yarn.

3 Claims, 4 Drawing Sheets

WINDER FLY WASTE MANAGEMENT SYSTEM

BACKGROUND OF THE INVENTION

This application is a continuation of application Ser. No. 924,387 filed Oct. 29, 1986, now abandoned.

1. Field of the Invention. The invention relates to an improved yarn traversing apparatus of a rotary blade type for use in a yarn winding machine. The apparatus reciprocates the yarn transversely to its running direction over a predetermined traverse stroke while the running yarn is wound onto a rotating package at high speed.

2. Description of Related Art. In high-speed melt spinning of synthetic fiber, an essential element of required machinery is a high-speed winder. The winder is constructed of many mechanical components such as high-speed traverse, high-speed spindle, and automatic yarn transfer mechanisms. A turret type yarn winding apparatus suitable for high-speed melt spinning is disclosed in U.S. Pat. No. 4,216,920, issued Aug. 12, 1980, to Tambara et al. An important factor in winding yarn onto the yarn package is to maintain the proper helix angle required for good package formation. For the winder used in the high-speed melt spinning process, high-speed traverse must be provided so as to keep this helix angle proper.

When the traverse mechanism is considered, it is very important that the yarn guide return quickly and smoothly at the end of the traverse width. Packages wound by the winder, especially at high speeds, have hard edges on both sides, as formed by the reversing yarn. The intensity of this effect, which influences yarn quality, varies according to the shape of the trail of the traversing yarn near the returning point. If the yarn returns quickly and smoothly at the end-point of the traverse, the hard edge effect is reduced.

From the early days of textile manufacture efforts have been made to develop a high-speed traverse system, using various types of mechanisms such as guide cams, rotary drums, chains, belts, and rotary blades. Today, a popular yarn traverse mechanism is based on the guide cam. It is applicable, however, for winders working at lower speeds, for example not exceeding 4500 meters per minute. Of course, it is possible to use the apparatus to wind up the yarn at 6000 meters per minute, but in this case either the guide will soon be broken in the reciprocating motion forced by the cam or the package form will not be good.

Therefore, for the high-speed melt spinning winder, other types of traverse mechanisms have been sought to achieve higher traverse speed. A mechanism appropriate for the high-speed winder is disclosed in U.S. Pat. No. 3,650,486 issued Mar. 1972, to Hasegawa et al. The effective traversing width is divided into two or more groups, each group comprising a pair of coaxially disposed rotary blade mechanisms, and the yarn is reversed and transferred from group to group by the rotation of the rotary blades with a predetermined phase difference. Since there is no reciprocating part, the mechanism is applicable to winders working at speeds exceeding 6000 meters per minute. In each group of the traversing width, there are two blades rotating in opposite directions and set on the same axis, which carry the yarn to the right and to the left. The driving mechanism for both blades can be mounted on one side of the rotational plane of the blades. This enables a very compact design of the traverse apparatus, and hence the free length (defined as the distance between the yarn contact point of a rotary blade and that of the package, or otherwise that of the roller) can be kept short for all blades.

The yarn traversing system discussed above has proven to be an effective system for high-speed melt spinning of synthetic yarn. However, substantial problems occur from accumulated waste yarn working into the rotary blade mechanism. During winding of yarn on a spindle to build a yarn package, waste yarn can accumulate in the traversing rotary blade mechanism. At the time of transfer of winding from a completed package to a new spindle for example during the operation of a turret type yarn winding apparatus such as that of Tambara et al. referenced above, substantial amounts of fly waste yarn is produced. Such waste yarn works its way into the gears and bearings of the traversing rotary blade mechanism. The resulting wrapping of waste yarn within the mechanism causes the traverse motor to quit and the overall winding operation to be halted. The traversing rotary blade mechanism must then be serviced, creating a period of down-time, with lost conversion for the winder.

An important improvement to the winder traversing rotary blade mechanism provided herein reduces substantially the potential for wrapping of fly waste yarn within the mechanism, thereby increasing machine conversion and decreasing maintenance time and expense.

SUMMARY OF THE INVENTION

In yarn traversing apparatus of the rotary blade type wherein there are at least two yarn traversing groups arranged in succession along an effective yarn traversing width at a position upstream of the package on which said yarn is to be wound, each said yarn traversing group comprising a pair of coaxially disposed rotary blades each mounted on separate coaxially disposed rotatable shafts, the improvement wherein each said rotary blade connected to said rotatable shaft has associated therewith means to provide a smooth contoured outline serving to reduce substantially protrusions and crevices associated with said rotary blades and said rotatable shafts, and means to direct air across said yarn traversing groups, in an amount sufficient to remove and to prevent entry of fly waste yarn from said rotary blades and said rotatable shafts. The resulting structure has substantially reduced potential for wrapping of waste yarn about the traversing mechanism, with an important increase in machine conversion and decrease in maintenance time and expense.

DETAILED DESCRIPTION OF THE PREFERRED EMBODIMENT

The structure and functional effect of a turret type yarn winding apparatus is described in U.S. Pat. No. 4,216,920 to Tambara et al., hereby incorporated by reference.

Figure 1:
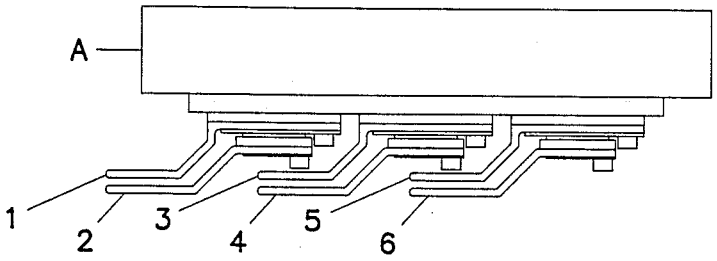
FIG. 1 (PRIOR ART)
FIG. 1 is a front view of a traversing cassette assembly of the prior art, which has three pairs of rotary blades mounted on coaxially disposed shafts.
Figure 2:
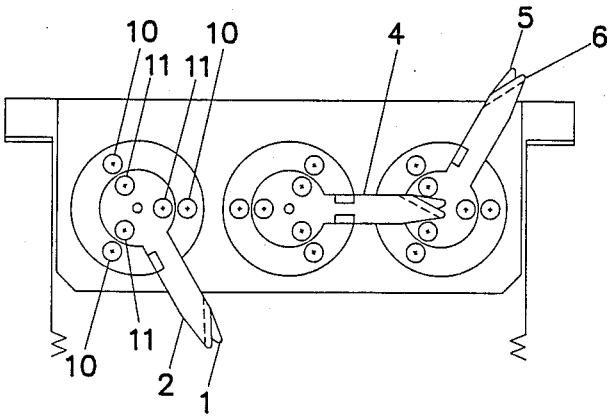
FIG. 2 (PRIOR ART)
FIG. 2 is a bottom view of the prior art assembly of FIG. 1.

FIGS. 1 and 2 show a traversing cassette assembly A of the prior art. A traversing cassette assembly provides a compact mechanism comprising the traversing rotary blade assemblies which can be conveniently inserted and removed from the winder for necessary servicing. While the preferred embodiment is described in relation to use of cassette assemblies, it will be understood that the invention is of even greater importance to hard-mounted rotary blade mechanisms which are not contained in cassette assemblies, and therefore cannot be as readily serviced without an even greater loss of conversion time. In FIGS. 1 and 2 pairs of blades 1 and 2, 3 and 4, 5 and 6 are coaxially and rotatably disposed. A mechanism for rotatably actuating the blades and effecting the traverse of running yarn is disclosed in U.S. Pat. No. 3,650,486 to Hasegawa et al., hereby incorporated by reference.

Figure 3:
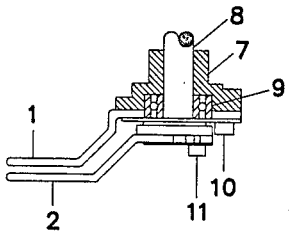
FIG. 3 (PRIOR ART)
FIG. 3 is a vertical partial sectional view of a pair of coaxially disposed rotary blades of FIG. 1, each blade mounted on a separate rotatable shaft.

With reference to FIG. 3, blades 1 and 2 are shown mounted to rotatable shafts 7 and 8, respectively, relevant portions being shown. Bearing 9 is disposed between shafts 7 and 8. Blade 1 is mounted to shaft 7 by bolts 10. Blade 2 is mounted to shaft 8 by bolt 11. This figure is illustrative of a prior art assembly and shows problem areas confronted in operation. When rotating, the exposed heads of bolts 10 and 11 serve to catch and accumulate fly waste yarn. Such yarn can readily wrap about the rotating shafts 7 and 8 and work its way into the bearing 9, causing the rotation to stop.

Figure 4:
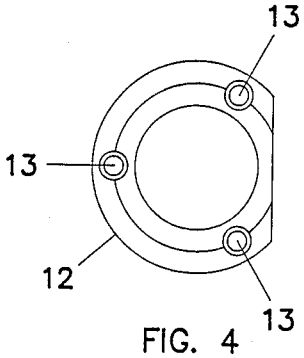
FIG. 4 is a top view of an outer spacer ring for mounting on the outer rotary blade.
Figure 5:
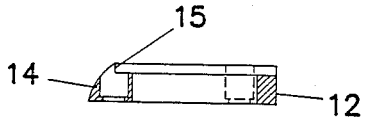
FIG. 5 is a sectional side view of FIG. 4.
Figure 6:
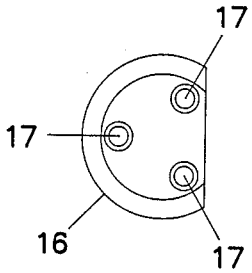
FIG. 6 is a top view of an inner spacer ring for mounting on the inner rotary blade.
Figure 7:
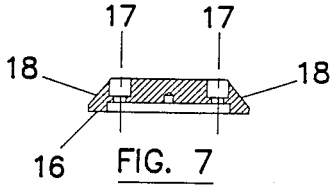
FIG. 7 is a sectional side view of FIG. 6.
Figure 8:
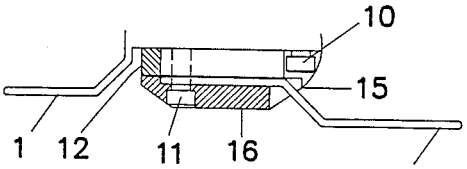
FIG. 8 is a sectional side view of a pair of coaxially disposed shafts with rotary blades having inner and outer spacer rings mounted thereon.

FIGS. 4–7 disclose spacer rings designed to be attached to the rotatable shafts and blades. The spacer rings are constructed of known materials. Due to the high speed of the rotation, a strong, lightweight material is preferred. Aluminum is an example of such material which can be readily machined to the desired shape. FIG. 4 is a top view of the outer spacer ring 12 provided with holes 13 to permit attachment to the rotable shaft. The sectional side view in FIG. 5 shows the contoured edge 14 and the lip 15. Similarly, in FIGS. 6 and 7, the inner spacer ring 16 is shown provided with holes 17 and contoured edges 18. FIG. 8 shows blade 1 and outer spacer ring 12 attached to the outer rotatable shaft (FIG. 3) by means of bolts 10. Similarly, blade 2 and inner spacer ring 16 are attached to the inner rotatable shaft (FIG. 3) by means of bolts 11. It is essential to the invention that the elements of the structure cooperate to produce a smooth outline, with minimal protrusions in order to provide the least possibility for the accumulation of fly waste. Note in FIG. 8 how lip 15 on the outer spacer ring cooperates with the inner shaft 8 and inner blade 2 to closely restrain entry of fly waste into the bearing 9 (FIG. 3). The means of fastening the spacer rings to the shafts by means of bolts is a preferred embodiment when provided the prior art structure of FIGS. 1 and 2. It will be understood that the desired contoured shape can also be made an integral part of the design of the blades, and the blades attached by other ways known in the art. The important aspect is to provide a smooth, contoured outline, with bolts or other fasteners recessed adequately to reduce as much as possible any protrusion or crevice which may serve to snag or accumulate unwanted fly waste, thus eliminating such areas in which the waste yarn may wrap and be held by the cassette assembly.

While the smooth, contoured shape discussed above serves to substantially reduce the potential for wrapping of waste yarn about the traverse mechanism, a second aspect of the invention requires the use of an air purging system to direct air across the traversing cassette assembly to prevent loose yarn and fly waste from entering therein. The air purging system in combination with the smooth, contoured shape of the rotatable blades serve to effectively reduce stoppages of the traversing caused by such waste yarn. Air blowing across the traversing cassette assembly purges loose yarn accumulated in the rotating mechanism and pressurizes the area so that loose yarn and fly waste generated during transfer of winding from spindle to spindle cannot enter the cassette assembly.

Figure 9:
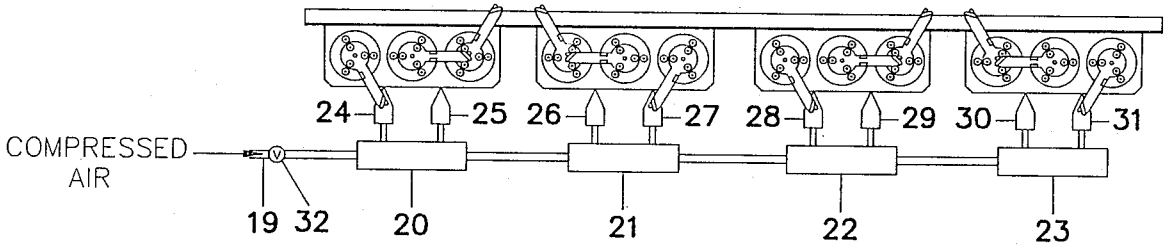
FIG. 9 is a bottom view of the air purging system of this invention, shown associated with a bank of traversing cassette assemblies.

FIG. 9 illustrates a bottom view of a winder arrangement consisting of a bank of four traversing cassette assemblies, though there may be any desired number. The cassette assembly is a preferred mode for traversing rotary blade mechanism of the type contemplated herein since it provides for ease of maintenance by removal and replacement as assemblies when necessary, resulting in substantially less down-time for the winder. While each cassette assembly can be removed from the bank and replaced with another cassette assembly when required, there is still a cost of time and resulting lost conversion. Clean air is provided from an air source by known methods to the air line 19, which communicates with housings 20, 21, 22 and 23 in series. Air nozzles 24–31 are connected to respective housings as illustrated. Each air nozzle is preferably adjustable to regulate the flow of air to insure an even distribution. Each nozzle is directed to a point intermediate the rotating blades in the cassette assemblies. It will be understood that more or fewer nozzles can be utilized so long as an even flow of air can be directed across the traversing cassette assemblies. While it would be preferred to maintain a constant flow of air across the cassette assemblies throughout the winding operation, this creates substantial economic considerations due to the costs of moving such a volume of air. A large amount of fly waste yarn is created during transfer of winding from a completed package to a fresh bobbin. Stopping the package and cutting the yarn during such transfer operation creates additional fly waste yarn. In a preferred embodiment valve 32 is actuated to supply air during such yarn transfer operation. For example, with a turret winder such as that in Tambara et al., when the turret begins to rotate valve 32 is actuated by control means to supply air for a period while the turret rotates to bring the new spindle to position and the completed yarn package is brought to a stop, a period as long as about 20 seconds. In this way air usage can be conserved, while supplying it at the times of greatest potential problem from the fly waste.

What is claimed:

1. In a yarn traversing apparatus of the rotary blade type comprising, in combination: at least two yarn traversing groups arranged in succession along an effective yarn traversing width at a position upstream of a package on which said yarn is to be wound; each said yarn traversing group comprising a pair of coaxially disposed rotary blades each mounted on a separate rotatable shaft; said pair comprising an inner blade and an outer blade; and actuating means for effective rotation of said blades of said respective yarn traversing groups to effect traverse of said yarn in one direction by the cooperative action of one blade of each yarn traversing group and traverse of said yarn in an opposite direction by the cooperative action of the other blade of each yarn traversing group; whereby said yarn is transferred from a rotary blade of one of said yarn traversing groups to a rotary blade of a neighboring yarn traversing group at a boundary between said two yarn traversing groups; the improvement wherein each said rotary blade connected to said rotatable shaft comprises means to provide a smooth contoured outline serving to reduce substantially protrusions and crevices associated with said rotary blades and said rotatable shafts, and means to direct air across said yarn traversing groups, in an amount sufficient to remove fly waste yarn from and to prevent entry of fly waste yarn to said rotary blades and said rotatable shafts, wherein said means to provide a smooth contoured outline comprises an outer spacer ring mounted to each outer blade of each pair of coaxially disposed rotary blades, and an inner spacer ring mounted to each inner blade of each pair of coaxially disposed rotary blades, said outer spacer ring and said inner spacer ring cooperatively shaped to provide said smooth contoured outline.

2. The yarn traversing apparatus of claim 1 comprising at least three said yarn traversing groups.

3. The yarn traversing apparatus of claim 2 wherein said means to direct air comprises an air source connected by air line means to a plurality of air nozzles, said air nozzles directed to provide air across said yarn traversing groups.

* * * * *